United States Patent [19]

Topinka

[11] Patent Number: 4,514,148

[45] Date of Patent: Apr. 30, 1985

[54] HYDRAULICALLY ACTUATED PUMP

[75] Inventor: George F. Topinka, Glen Ellyn, Ill.

[73] Assignee: Carter Controls, Inc., Lansing, Ill.

[21] Appl. No.: 438,323

[22] Filed: Nov. 1, 1982

[51] Int. Cl.[3] ..... F04B 21/08

[52] U.S. Cl. ..... 417/403; 92/85 B; 92/143; 92/171

[58] Field of Search ..... 91/305, 306, 311, 313, 91/314; 92/8, 85 R, 85 B, 86, 143, 165, 168, 169, 171; 417/401, 403

[56] References Cited

U.S. PATENT DOCUMENTS

| | | | |
|---|---|---|---|
| 1,066,483 | 7/1913 | Fournia | 91/313 X |
| 1,536,787 | 5/1925 | Grace | 91/314 X |
| 1,879,370 | 9/1932 | McAllister | 92/168 X |
| 2,898,867 | 8/1959 | Saalfrank | 92/168 X |
| 3,540,741 | 11/1970 | LeFebvre | 92/168 X |
| 3,929,057 | 12/1975 | Kondo | 92/143 X |
| 4,055,107 | 10/1977 | Bartley | 92/168 X |
| 4,211,151 | 7/1980 | Wallischeck | 92/165 R X |

*Primary Examiner*—Leonard E. Smith

*Attorney, Agent, or Firm*—Allegretti, Newitt, Witcoff & McAndrews, Ltd.

[57] ABSTRACT

An hydraulic cylinder for driving a reciprocating pump at 5000 to 10,000 psi pressures having a separate spool casing which serves as a detachable extension of the cylinder. The detachable spool casing houses in a single grouping seals for the fluid being pumped, seals for the hydraulic fluid driving the piston, a bearing for the piston rod, and lubricating means for the seals and bearings. This construction provides ready access to these parts for repair and assures concentricity between the piston rod and the bearings and seals in which it reciprocates.

In one embodiment a wiper ring is provided between seals to scrape from the piston rod abrasive material in the fluid being pumped and discharge it from the cylinder. In another embodiment an external shock absorber decelerates the piston at one end of its extended stroke, the shock absorber also serving to actuate a valve controlling flow of hydraulic fluid to the cylinder.

7 Claims, 5 Drawing Figures

HYDRAULICALLY ACTUATED PUMP

This invention relates to an improved hydraulic cylinder which is especially useful for driving at high speeds a reciprocating pump used to pump liquids or slurries into a well at pressures in the range of 5,000 to 10,000 psi. Well-servicing liquids frequently contain abrasive particulate material which works its way into the cylinder when the seals around the piston rod begin to wear. If not removed, it will score the bearings, damage seals, and cause reduction in the hydraulic pressure within the cylinder.

One of the objects of this invention is to provide an hydraulic cylinder which may be easily disassembled to provided access to the internal seals for purposes of repair and maintenance. Also, to provide means for removing particulate material from inside the cylinder without disassembling the parts surrounding the seals.

Another object is to provide a separate spool casing which serves as a detachable extension of the cylinder and houses in a single grouping seals for the fluid being pumped, seals for the hydraulic fluid driving the piston, a bearing for the piston rod and lubricating means for the seals and bearings. This construction assures concentricity between the piston rod and the bearings and seals in which it reciprocates, an important consideration where the tolerances are exceedingly close in order to assure proper operation at the high fluid pressures involved.

In one embodiment of the invention, a wiper ring is provided in a groove inside the spool casing, between two sets of seals which seal in opposite directions. The wiper ring scrapes from the piston rod any abrasive or other foreign material which may enter the spool casing from the pump, and directs it to an adjacent drain groove leading outside the cylinder.

Another object is to provide an external shock absorber to decelerate the piston at the end of its extended stroke, which shock absorber also serves to actuate a valve controlling the flow of hydraulic fluid to the main cylinder.

These and other objects and advantages of the invention will become apparent from the following description when read in conjunction with the accompanying drawings, in which FIG. 1 is a diagrammatic view of the hydraulic cylinder, pump and associated parts for supplying and controlling the flow of hydraulic fluid under high pressure:

Figure 1:
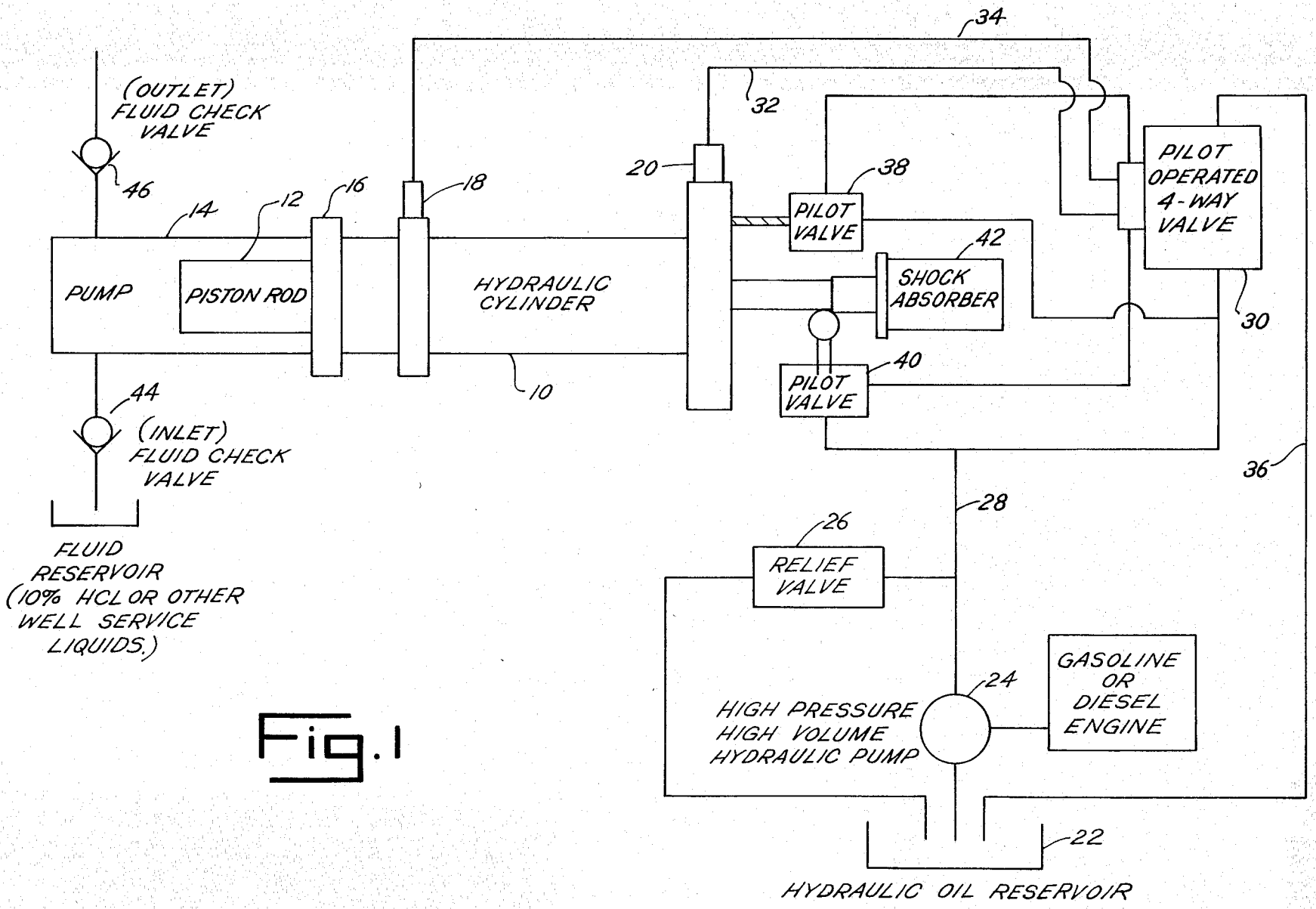

FIG. 1 is a diagrammatic drawing showing the manner in which the hydraulic fluid flow to and from the hydraulic cylinder is controlled. The hydraulic cylinder 10 has a piston rod 12 which reciprocates within the cylinder and within a pump 14 axially aligned with and connected to the cylinder at 16. The piston rod 12 serves as a piston within the pump 14, sucking liquid from the fluid reservoir past the check valve 44 on the suction stroke, and expelling said liquid at high pressure past the check valve 46 on the pressure stroke. The fluid is discharged into a well or the like at pressures between 5,000 and 10,000 psi.

The hydraulic cylinder is driven by high pressure fluid generated by a pump 24, driven by an internal combustion engine. A suitable pump will produce pressures in the range of 6,500 psi at a flow rate of 330 GPM. The pressurized hydraulic fluid flow through the line 28 to a pilot operated four-way valve 30. When the valve is completely closed, pressurized fluid produced by the pump 24 circulates through a by-pass and relief valve 26 back to the hydraulic oil reservoir. Forward movement of the piston within the hydraulic cylinder 10 is initiated by actuating the pilot valve 38, which in turn opens a port in the four-way valve, which admits fluid to the line 32 and the port 20 communicating with the cap end, or rear end, of the hydraulic cylinder. Fluid ahead of the piston is expelled through port 18, and into the reservoir through valve 30. When the piston in the cylinder reaches the end of its stroke, pilot valve 40 is actuated, which shifts the valve 30 so as to admit fluid to the line 34 communicating with port 18 on the head end of the cylinder. This reverses the piston which retracts the piston rod 12. The fluid within the cylinder on the cap side is expelled during retraction through the port 20 and the four-way valve to the reservoir. In fully retracted position, the piston within the hydraulic cylinder actuates pilot valve 38 to start the cycle over again.

A shock absorber 42 cooperates with the piston of the hydraulic cylinder to decelerate the forward movement of that piston toward the end of its stroke. The piston and the piston rod 12 connected thereto are large parts, and, when moving at high speeds under high pressure, have considerable inertia. For example, a cylinder constructed in accordance with the invention may be eight feet long and have a six foot stroke, with a five inch bore. The piston velocity in the forward direction may be five feet per second and the retraction speed about six feet per second.

Figure 2:
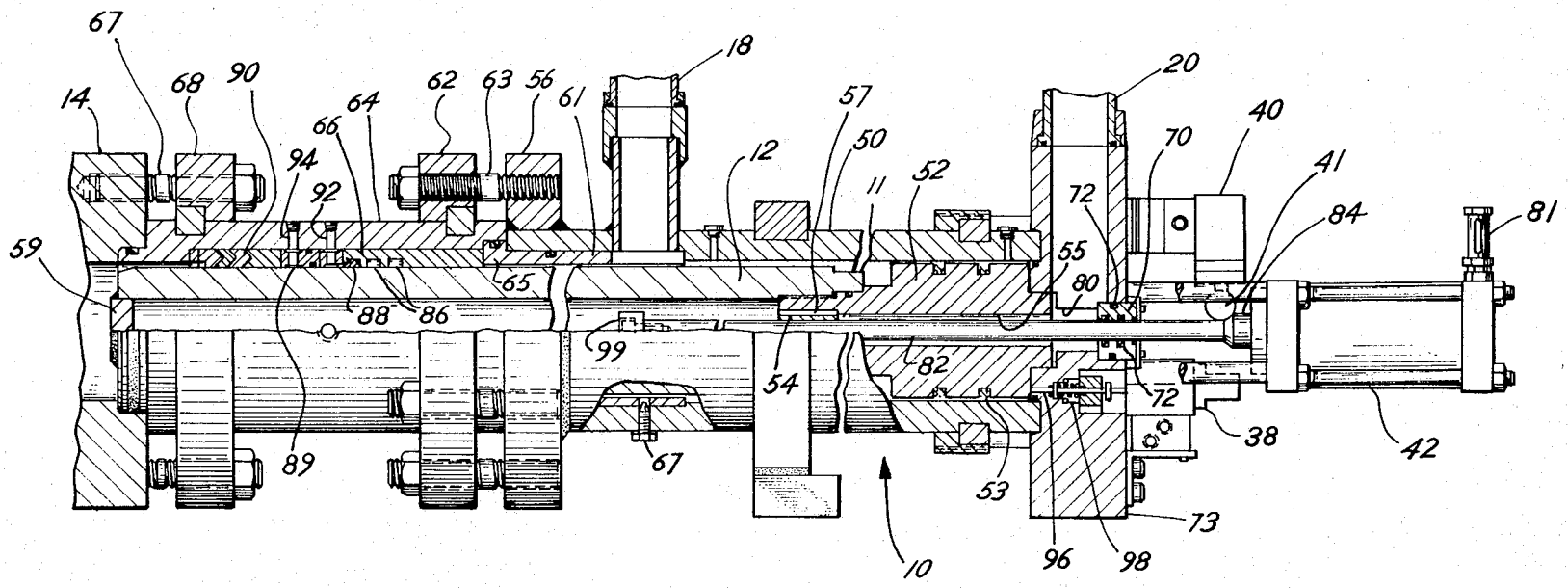
FIG. 2 is a longitudinal sectional view of the cylinder constructed in accordance with the invention.

Referring to FIG. 2, the primary cylinder 10 has a cylindrical housing 50 in which primary piston 52 is disposed. The piston 52 has two or more sealing rings 53 in its outside diameter which bear against the internal surface of the housing 50. An end cap 73 seals the right hand end of the cylinder and has a central opening therethrough for admitting the shaft 82 of the shock absorber 42 to the interior of housing 50. The head end of the cylinder consists of a separate spool assembly 64 which is axially aligned with and connected to the cylinder 10. To assure proper assembly without misalignment, a sleeve 61 with an integral collar 65 fits closely within enlarged bores of the housing 50 and casing 64, respectively. Suitable sealing rings in the outer surfaces of the sleeve and collar bear against the bores in which they fit. The spool casing 64 is secured to housing 50 by means of a series of circumferentially-spaced bolts 63 which lock flange 62 to flange 56. The integrity of alignment is mandatory for proper action of the cylinder because of the close tolerance between the piston rod and its bearings required to retain the very high fluid pressure under which the piston operates. The spool casing 64 has a second flange 68 on its outer end which is adapted to secure a pump housing 14 or the like in axial alignment with the cylinder 10 by means of bolts 67 which extend from the housing 14 through the flange 68.

The primary piston 52 has a central bore 55 for receiving the connecting rod or piston rod 82 of the shock absorber 42. Connected to the end of the primary piston 52 is a piston rod 12 which is hollow. In FIG. 2 the cylinder is broken, as indicated at 11, signifying that the cylinder and the rod 12 is much longer than actually shown in the drawing. The end of the hollow rod 12 is sealed by means of a cap 59. The inner end of the hollow rod 12 is supported by the piston 52 and the outer end is supported in a bearing comprising a sleeve 66 lining the interior of the spool casing 64. The clearance between the bearing sleeve 66 and the rod 12 is very slight which means these parts must be precisely aligned.

Figure 5:
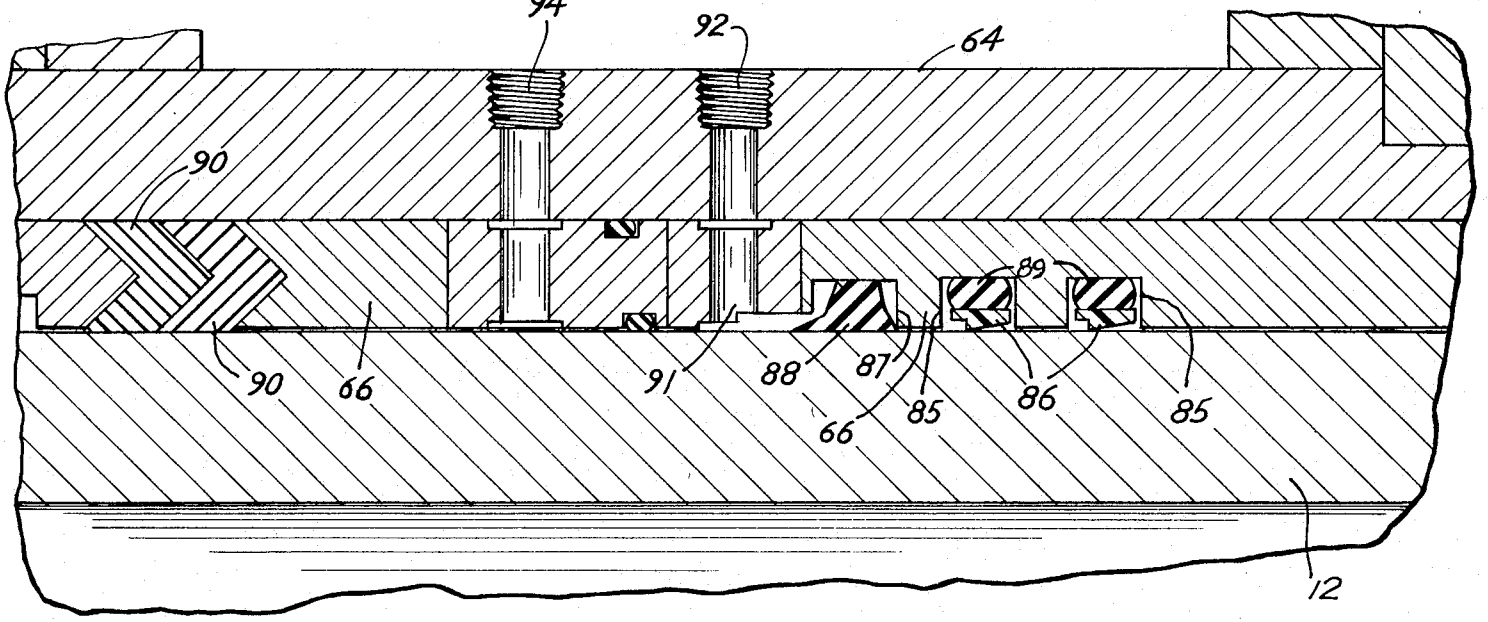
FIG. 5 is an enlarged view of the seal area of FIG. 2.

The sleeve 66 has a plurality of circumferential grooves 85,87 in its inside diameter, as best shown in FIG. 5. The grooves 85 contain dual sealing rings, and inner ring 86 made of Teflon and a cushion ring 89 of synthetic rubber or other suitable material which will withstand the very high pressures of the hydraulic fluid within the casing on the pump side. The head end of the sleeve 66 abuts packing seals 90 which are compressed between the inner diameter of the spool casing 64 and the outer diameter of the rod 12. The seals 90 are designed to prevent liquids or slurries in the pump 14 from moving rearwardly into the spool casing. Thus two sets of seals are provided, sealing the interior of the spool 64 from opposite directions. Nevertheless, when the seals 90 become worn, slurries will penetrate past the seals and provision must be made to dispose of this foreign material, which may score the bearing 66 and damage the seals 86, thus reducing the pressure within the housing 50. The liquids pumped, in addition to slurries, include 157% hydrochloric acid, cements and other well-servicing materials, all of which are corrosive. The surface of the piston rod 12 must be extremely hard, very smooth, chemically inert and impervious to such fluids.

The ring 88 in stepped groove 87, which communicates with groove 91, serves as a wiper and, because of its cross-sectional wedge shape, will scrape foreign material from the surface of the rod 12 into the groove 91 which connects to a port 92 communicating with the atmosphere outside the casing. Thus, any liquid or slurries which move into the spool casing 64 from the pump 14 are removed in this way. Several radial ports 92 may communicate with the groove 91 as desired. Port 94 is provided for introducing lubrication into the bearing and pump seals.

It will be noted that the spool casing 64, with its internal parts, can be removed from the end of the housing 50 and from the end of the pump 14 by removing the nuts on the bolts 63, 67. The spool will slide off the end of the rod 12 to permit repair or replacement of the ring seals 86, the wiper exclusion ring 88, and the packing seals 90. This is an important feature of the invention because when the cylinder is connected to a pump which pumps liquids containing particulate material, it is necessary to repair the seals at intermittent intervals. In replacing the spool casing it is essential that the parts be accurately aligned with the housing 50, since the rod 12 is relatively long and fits closely within the sleeve 66.

Ports 18 and 20 connect the interior of the housing 50 with a source of high pressure hydraulic fluid as shown in FIG. 1. The fluid may flow in either direction through the ports, depending upon the direction in which the piston 12 is moving.

To cushion the forward movement of the piston 52 as it nears the end of its stroke prior to reversing direction, a shock absorber 42 is provided, connecting to the cap end of housing 50. The shock absorber comprises a cylinder containing a piston, not shown, connecting to rod 82. The cylinder and rod 82 are axially aligned with housing 50 and the rod 82 extends through the opening 80 in the cap 73 and the opening 55 in piston 52. The outer end of the rod 82 is supported by a bearing 54 in the end of the opening 55. An enlarged head, or button, 99 is provided on the end of the rod 82. As the piston 52 moves forward it picks up the rod 82 by engaging the shoulder on the button 99 near the end of its stroke. A second bearing 70 is provided in a bore within the cap 73 to support the rod 82 in precise alignment. The bearing 70 contains suitable seals 72 which bear against the surface of the rod 82 and against the cap 73 to prevent fluid leakage. The piston inside the shock absorber 42 moves past tube metering holes through which fluid in the cylinder may move at a predetermined rate as the piston moves forward. This action results in drag on the primary piston 52 to cushion the arrest of its forward motion before it reverses.

Pilot valve 38 is mounted on the rear face of the cap 73 within a blind bore and is actuated by means of a pin 96 which is spring-biased to the extended position. Valve 38 is opened when the face of piston 52 moves into full retracted position to depress pin 96. Another pilot valve 40 is mounted adjacent to the housing of shock absorber 42 and includes an actuating roller 41 which is spring-biased toward the rod 82. The rod 82 has an enlarged end 84 which serves as a cam to actuate the pilot valve 40 as the rod 82 moves forward to its extended position under the force of the piston 52. As indicated, pilot valve 40 when actuated in this manner shifts the four-way valve to reverse the flow of fluid and retract the piston 52.

Figure 3:
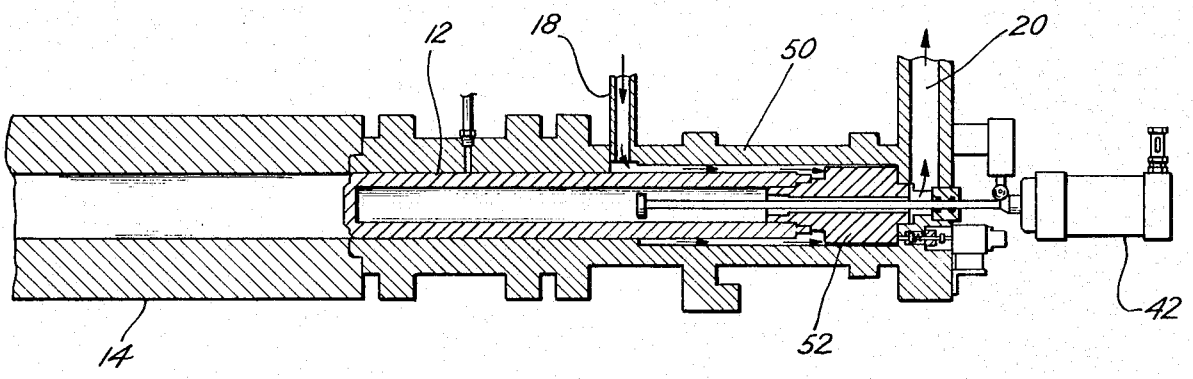
FIG. 3 is a simplified sectional view similar to FIG. 2, showing the piston, piston rod and associated parts in retracted position.
Figure 4:
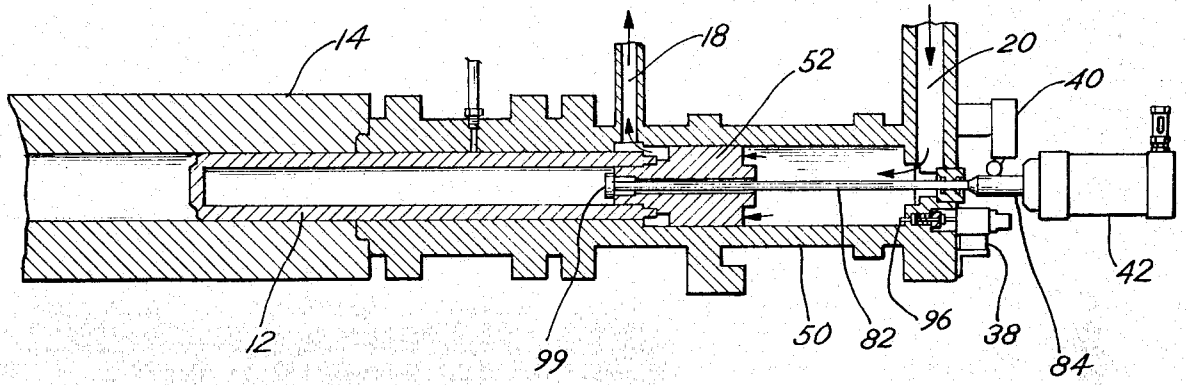
FIG. 4 is a view like FIG. 3, showing the piston, piston rod and associated parts in extended position.

The operation of the device is best understood by referring to FIGS. 3 and 4 where fluid flow is indicated by arrows. The piston 52 is shown in retracted position in FIG. 3. Hydraulic fluid enters through the port 20 causing the piston to move forward, as shown in FIG. 4. The fluid ahead of the piston is expelled through the port 18. The hollow rod 12, of course, moves with the piston and reciprocates inside the pump 14 to suck in and expel liquid under high pressure. As the piston 52 comes within a couple of inches from the end of its forward stroke, the forward end of the piston engages the button 99 which causes the piston and the piston rod 12 to come to a stop. The piston inside the cylinder of the shock absorber 42 can move with the primary piston 52 at a rate permitted by fluid flow through perforations in the metering tube. This results in deceleration of piston and the rod 12 within the pump 14. At the end of its stroke, rod 82 actuates pilot valve 40 as shown in FIG. 4, causing the hydraulic fluid to reverse flow, entering through port 18 and exiting through port 20 as shown in FIG. 3. As the piston 52 retracts under the force of the hydraulic fluid entering through port 18, the rod 82 is retracted with it by reason of hydraulic fluid inside the hollow rod 12 bearing against the end of the button 99. When the piston 52 is fully retracted, it engages the pin 96 extending from the pilot valve 38 to once again reverse the fluid flow by means of the four-way valve 30, whereupon the cycle repeats. It will be noted that conduit means 57 is provided through the head end bearing of the piston 52 so that hydraulic fluid can flow from the interior of the rod 12 as the piston 52 returns to retracted position. The hydraulic fluid inside the rod 12 moves the rod 82 back into its retracted position.

Other embodiments of my invention will be apparent to those skilled in the art without departing from the principles of the invention.

I claim:

1. An hydraulically-operated cylinder for actuating a reciprocating pump at high speed and pressure comprising a primary cylinder having a head end and a cap end, a primary piston mounted for reciprocation within said cylinder, said piston having a piston rod, a spool casing connected at one end to the head end of said primary cylinder, said casing enclosing said piston rod, said rod being adapted to operate within a pump connected to the other end of said casing, said casing and said primary cylinder each having an external circumferential flange for detachably securing said casing and cylinder together in axial alignment, a bearing sleeve within said spool casing, said sleeve having two sets of sealing rings therein, axially spaced from each other, a wiper exclusion ring disposed between the two sets of sealing rings and bearing against said primary piston rod, and radial ports extending through said sleeve and said spool casing for discharging foreign material from the area of the rod and sealing rings.

2. The cylinder of claim 1 in which said primary piston and piston rod have a central axial opening therein, and which includes an external shock absorber connected to the cap end of said cylinder for decelerating said primary piston toward the end of its forward stroke, said shock absorber comprising a shock absorber body aligned with said primary piston rod, a piston disposed within said body having a shock-absorber-actuating rod extending therefrom through said central axial opening in said primary piston and beyond the head end of said primary piston, stop means on the head end of said actuating rod for engaging the forward end of said primary piston to effect deceleration thereof, and means for retracting said actuating rod responsive to hydraulic pressure acting upon said primary piston.

3. The cylinder of claim 1 which includes a pair of ports, one at said cap end and one at said head end, each port communicating with a source of high pressure hydraulic fluid, and valve means for controlling the flow of fluid to said cylinder to cause said primary piston to reciprocate within said cylinder.

4. The cylinder of claim 2 which includes valve means for controlling the flow of hydraulic fluid to said cylinder to reciprocate the primary piston therein, a cam follower on said valve means and a cam on said shock-absorber-actuating rod for moving said cam follower to actuate said valve means.

5. The cylinder of claim 4 in which said stop means comprises a button on the end of said actuating rod of larger diameter than said rod.

6. The cylinder of claim 1 in which one of said radial ports is located between the two sets of seals, said wiper exclusion ring being disposed in a groove which communicates with said one radial port, said ring having an axially-extending, wedge-shaped flange which extends into said radial port to facilitate egress of any foreign material scraped off said primary piston rod by said wiper exclusion ring.

7. The cylinder of claim 2 in which said central axial opening in said primary piston rod is closed at the head end and filled with hydraulic fluid, and which includes a bearing for said piston rod mounted in the opening at the head end of said primary piston, said bearing containing conduit means to permit fluid flow from the inside of said central axial opening in said piston rod to the central opening in said primary piston.

* * * * *